US008019046B1

(12) United States Patent
Underwood et al.

(10) Patent No.: US 8,019,046 B1
(45) Date of Patent: Sep. 13, 2011

(54) APPARATUS FOR GENERATING SHORTWAVE RADIATION

(75) Inventors: James H. Underwood, Oakland, CA (US); Rupert C. C. Perera, Martinez, CA (US)

(73) Assignee: Eran & Jan, Inc, Martinez, CA (US)

( * ) Notice: Subject to any disclaimer, the term of this patent is extended or adjusted under 35 U.S.C. 154(b) by 204 days.

(21) Appl. No.: 12/385,642

(22) Filed: Apr. 15, 2009

(51) Int. Cl.
*H01J 35/00* (2006.01)
*H01J 35/08* (2006.01)

(52) U.S. Cl. ..... 378/119; 378/124

(58) Field of Classification Search ..... 378/119, 378/124, 143, 136
See application file for complete search history.

(56) References Cited

U.S. PATENT DOCUMENTS

| | | | | |
|---|---|---|---|---|
| 5,003,543 | A | 3/1991 | Morsell et al. | |
| 5,038,155 | A | 8/1991 | Yamagishi et al. | |
| 5,089,711 | A | 2/1992 | Morsell et al. | |
| 5,151,928 | A | 9/1992 | Hirose | |
| 5,539,764 | A | 7/1996 | Shields et al. | |
| 5,668,848 | A | 9/1997 | Rieger | |
| 5,759,336 | A | 6/1998 | Yamamoto et al. | |
| 6,238,515 | B1 | 5/2001 | Tsujimoto et al. | |
| 6,538,257 | B2 | 3/2003 | Bisschops | |
| 7,456,417 | B2 * | 11/2008 | Murakami et al. | 250/504 R |
| 2005/0180043 | A1 * | 8/2005 | Rieger et al. | 360/85 |

FOREIGN PATENT DOCUMENTS

| | | |
|---|---|---|
| EP | 91113852.7 | 3/1992 |
| WO | WO 01/37618 | 11/2000 |

* cited by examiner

*Primary Examiner* — Irakli Kiknadze
(74) *Attorney, Agent, or Firm* — Theodore J. Bielen, Jr.

(57) ABSTRACT

An apparatus providing a source of shortwave electromagnetic radiation utilizing a tape having a first side and a second side and a laser beam focused and impinging on the first side of the tape. The apparatus utilizes a tape storage unit which delivers or feeds tape from the same. A base supports a first projecting element which contacts the second side of the tape emanating from the storage unit. A second projecting element supported by the base contacts the first side of the tape being fed from the tape storage unit. The portion of the tape between the first and second projecting elements constantly lies in a plane during the feeding of the tape and provides a target surface for a focused laser beam which generates shortwave radiation.

10 Claims, 3 Drawing Sheets

APPARATUS FOR GENERATING SHORTWAVE RADIATION

BACKGROUND OF THE INVENTION

The present invention relates to a novel and useful apparatus for generating shortwave length radiation such as EUV and X-rays.

In the past, EUV and X-ray radiation has been created by contact between a laser beam and a metallic member such as one composed of phosphor bronze. For example, solid targets have been employed to generate shortwave electromagnetic radiation. Since the laser beam creating such radiation is pulsed, only a finite number of shots may be taken on a solid target, typically, 90,000 shots as an upper limit.

An alternate system of generating such shortwave electromagnetic radiation involves the use of a metallic tape composed of a similar material. For example, 500 meters of a bronze-phosphor tape will allow approximately 500,000 shots of a focused laser beam.

To successfully employ a tape target in such systems, the tape must be continually advanced across the laser beam focal point. It is most important that the tape remain in a plane during such advancement for maintaining the focus of the laser upon the tape, in order to produce an adequate supply of shortwave electromagnetic radiation. Although the focused laser beam creates shortwave electromagnetic radiation, the impingement of the laser beam on a tape composed of copper, phosphor-bronze, and the like, also creates dimples which extend from the tape on the side opposite to the side where the initial contact of the focused laser beam occurs. Such dimpling generates debris and, most importantly, creates an uneven surface. Such uneven surface when contacting a take-up spool or roller directs the moving tape outside of the focal plane of the laser beam and, thus, disrupts the focusing of the laser beam on the tape. Needless to say, such defocusing of the laser beam interrupts the production of shortwave radiation in a consistent and reliable fashion.

Many systems have been proposed to generate electromagnetic radiation by contact of a portion of a medium with an intense pulsed laser beam.

For example, reference is made to U.S. Pat. No. 5,038,155 which shows a recording apparatus having a heat sensitive sheet that is conveyed by a series of rollers into a recording apparatus section.

U.S. Pat. No. 5,759,336 describes a resist removing apparatus in which a tape unit is moved horizontally to apply adhesive tape in a strip to a wafer supported on an applicator table. Another wafer is placed over the first wafer and a table is moved to simultaneously apply adhesive tape to the second wafer and remove adhesive tape from the wafer on the table at the same time.

U.S. Pat. No. 6,238,515 includes a system for sticking a wafer to a ring frame by using a transfer tape. The transfer tape is stuck to both a ring frame and the back of the wafer to connect these two members. A protective tape peeling table interacts with the adhesive tape to complete the transfer of the wafer.

PCT Publication WO 01/37618 describes the method of producing extreme ultraviolet radiation utilizing a laser beam on a solid target where the emitted part of the radiation streams from the opposite surface of the target at its contact with a focused laser beam.

U.S. Pat. Nos. 5,003,543, 5,089,711, 5,151,928, and European Patent Application 0474011 describe laser X-ray sources in which a laser beam, amplified and focused, interacts with a plasma target. This target may take the form of a metal tape which is held in place by pinching guide rollers.

U.S. Pat. Nos. 5,539,764 and 6,538,257 show X-ray and extreme ultraviolet radiation sources in which a laser beam is focused on a tape that is run between two rollers contacting the same side of the tape.

U.S. Pat. No. 5,668,848 describes an X-ray target tape assemblage in which a pulse laser beam is focused on a tape to produce short wavelength radiation. The tape serving as the source of the short wavelength radiation is wound onto a drum obliquely in order to fully utilize entire width of the tape in this regard.

An apparatus which provides a source of shortwave electromagnetic radiation and overcomes the deficiencies of the prior art would be a notable advance in the field of radiation physics.

BRIEF SUMMARY OF THE INVENTION

In accordance with the present invention a novel and useful apparatus for generating shortwave radiation is herein provided.

The apparatus of the present invention is used in conjunction with a source of shortwave electromagnetic radiation in the form of a metallic tape which comprises a first side and a second opposite side. A laser beam focuses and impinges on the first side of the tape to produce a plasma which in turn emits the desired shortwave radiation. The apparatus of the present invention includes a tape storage unit, such as a spool, which feeds the tape into the target area for impingement by the focus laser beam. The tape may take the form of a copper, phosphor-bronze, or other suitable metallic tapes known in the art to produce shortwave radiation, such as extreme ultraviolet radiation, X-ray radiation, and the like, when contacted by focus light from a laser. The storage unit may hold the tape in a folded or coiled configuration as desired.

A base is also provided in the present invention and includes a first projecting element which is supported relative to the base. The first projecting element contacts the second side of the tape being fed from the storage unit. The first projecting element may take the form of a roller or other like object. Likewise, a second projecting element is also supported by the base and is spaced from the first projecting element. Most importantly, the second projecting element contacts the first side of the tape being fed from the tape storage unit. In this manner, the portion of the tape positioned between contact with the first and second projecting units lies in a plane during the feeding of the tape from the tape storage unit. Such planar orientation is maintained while a laser beam focuses and impinges on the first side of the portion of the tape positioned between the first and second projecting units.

Take-up means, which may be in the form of a spool or reel, gathers the tape passing between the first and second projecting elements which has been targeted by the laser beam to produce the desired shortwave electromagnetic radiation. The take-up means may include a pinch mechanism simultaneously contacting the first and second sides of the tape fed by the tape storage unit. Such pinch mechanism may be constructed with a pair of rollers in this regard. Further, a spool may be employed for receiving the tape passing through the pinch mechanism rollers to store the expended tape. A motor would be linked to the spool of the take-up means to motivate the tape as it travels between the first and second projecting elements. In addition, a belt may link the spools of the take-up means and the storage unit.

The invention may further possess a collector located adjacent the second side of the tape between first and second projecting units. Such collector may be constructed as a receptacle which gathers debris created as a result of impingement of the laser beam on the metallic tape.

It may be apparent that a novel and useful apparatus for generating shortwave radiation has been hereinabove described.

It is therefore and object of the present invention to provide an apparatus for generating shortwave radiation which utilizes a metallic tape that interacts with a laser beam and is maintained in a planar configuration as the tape is advanced through the laser beam.

Another object of the present invention is to provide an apparatus for generating shortwave radiation which maximizes the use of a metallic tape as a source of the plasma generating desired shortwave radiation.

A further object of the present invention is to provide an apparatus for generating shortwave radiation which uses a metallic tape and is relatively simple and easy to operate.

A further object of the present invention is to provide an apparatus for generating shortwave radiation which uses a metallic tape and reliably produces shortwave radiation such as extreme ultraviolet radiation and X-rays.

Yet another object of the present invention is to provide an apparatus for generating shortwave radiation which uses a metallic tape and maintains that tape in a planar position after repeated impingements of the tape by a focused laser and obviates breakage of the tape as it is advanced through the laser target area.

A further object of the present invention is to provide an apparatus for generating shortwave radiation that utilizes a tape which is metallic in nature and which produces shortwave radiation upon impingement by a focused laser beam of constant intensity.

The invention possesses other objects and advantages especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
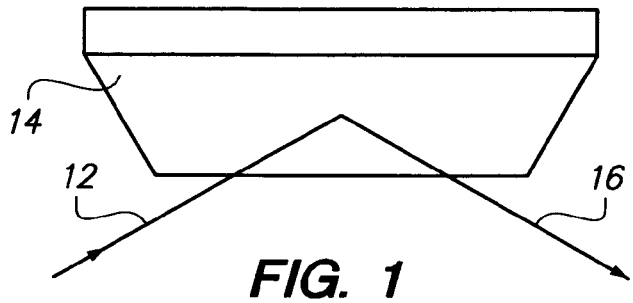
FIG. 1 PRIOR ART
FIG. 1 is a schematic view of a solid source of shortwave radiation found in the prior art.
Figure 2:
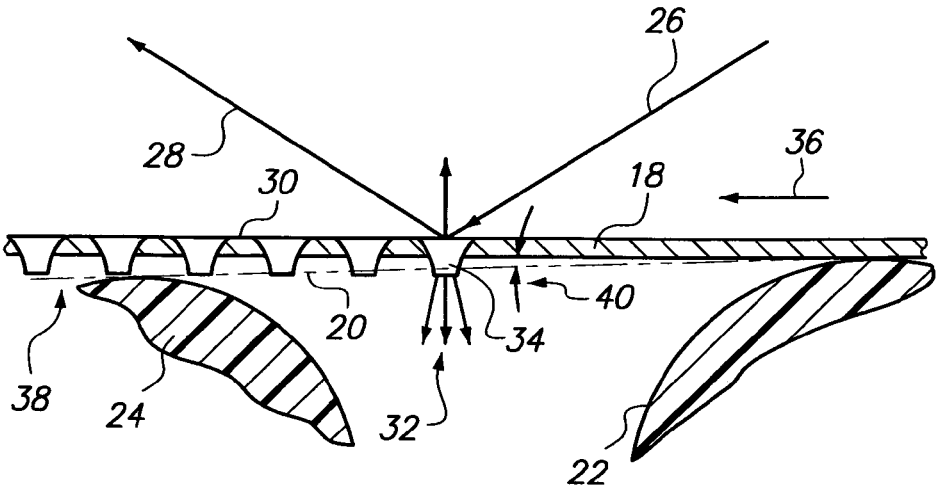
FIG. 2 PRIOR ART
FIG. 2 is a sectional view depicting the tape drives of the prior art used in the generation of shortwave radiation.
Figure 3:
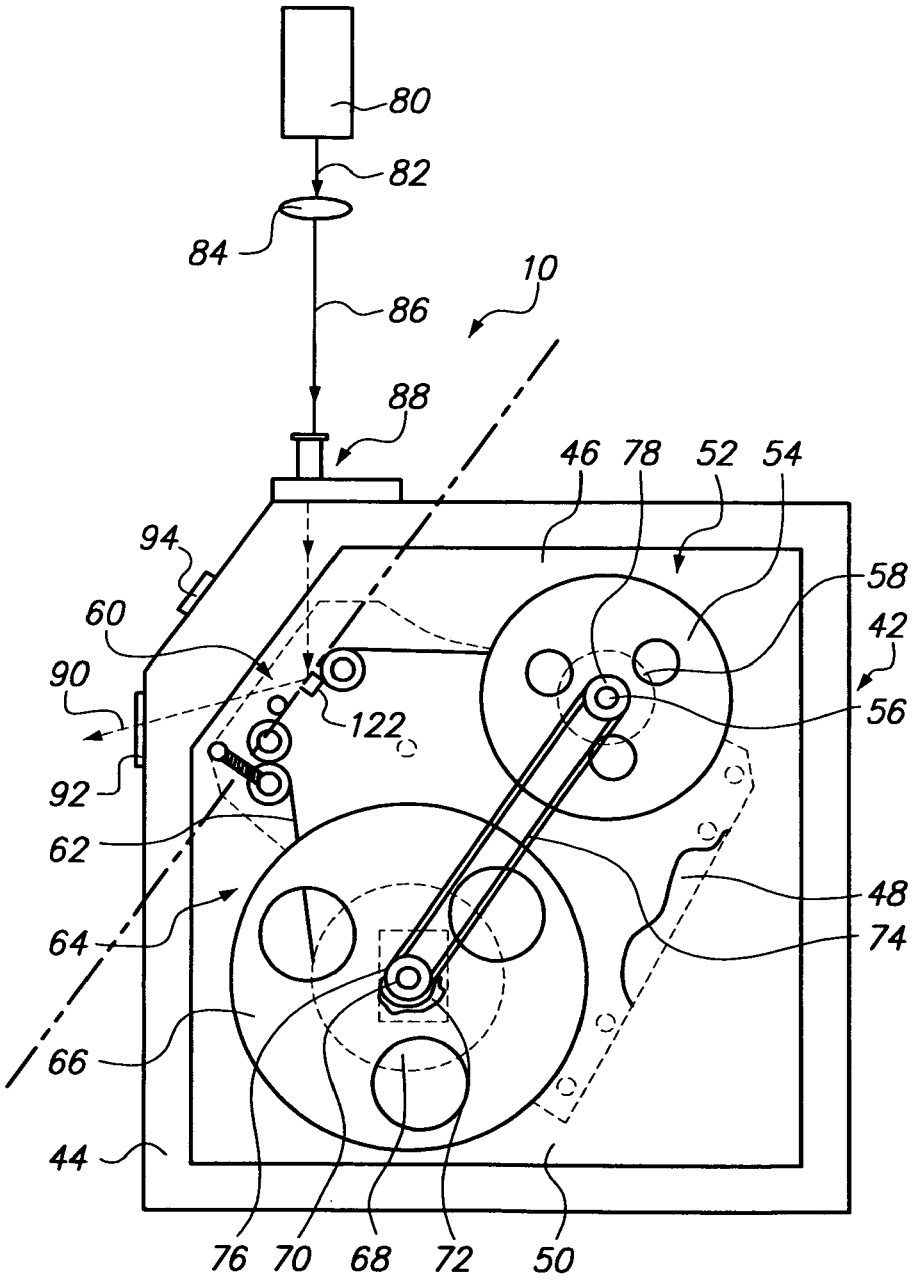
FIG. 3 is a top plan view of the apparatus embodying the present invention.

An embodiment of the invention as a whole is shown in the drawings by reference character 10, FIG. 3. Apparatus 10 is intended to supplant the systems of the prior art depicted in FIGS. 1 and 2. For example, FIG. 1 shows generation of shortwave length radiation by the impingement of a focused laser beam 12 on a solid metallic block 14. Shortwave length radiation beam 16 is generated for use. However, block 14 typically may only be used for 90,000 shots of pulses or laser beam 12.

FIG. 2 depicts another system of the prior art in which a metallic tape 18 is moved across a plane 20 by rollers 22 and 24. In other words, focused laser beam 26 produces a useful shortwave length radiation ray 28 when laser beam 26 is focused on the upper surface 30 of metallic tape 18. Most importantly, it should be noted that impingement of focused laser beam 26 on surface 30 of metallic tape 18 produces debris 32 and a pucker or dimple 34. Thus, as tape 18 moves according to directional arrow 36 a plurality of dimples 38 are formed. When any one of the plurality of dimples 38 contacts the roller 24, tape 18 is raised from plane 20 noted by directional arrows 40. The upshot is that laser beam 26 is no longer focused on the surface 30 of tape 18 which greatly reduces the production of extreme ultraviolet radiation and almost eliminates the production of X-ray radiation by the system shown in FIG. 2.

Referring now to FIG. 3, the apparatus 10 of the present invention is shown and includes a console for housing 42 that possesses a wall 44. A cover (not shown) may enclose chamber 46 formed by wall 44. A base 48, depicted chiefly in phantom, extends to the floor 50 of housing 42.

A tape storage unit 52 takes the form of a spool or reel which rotates about a central shaft 56. Reel 54 holds a roll of tape 58 of metallic material such as copper, phosphor-bronze, tin, and like material.

Tape roll 58 is led through a positioning mechanism 60 which will be discussed in greater detail hereinafter. Tape strip 62 then passes to take-up means 64 which includes a reel 66. The expended tape forms another roll 68 on reel 66. Reel 66 rotates about shaft 70, which is motivated by a motor 72 of conventional configuration. Belt or O-ring 74 links reel or spool 66 to spool 54, which turns at a constantly changing rate from reel or spool 66 during the operation of apparatus 10. Belt 74 is allowed to slip on pulleys 76 and 78, respectively, which are attached to shafts 70 and 56, respectively, to obviate breakage of tape strip 62.

Laser source 80, FIG. 3, produces a beam 82 of coherent radiation which is altered by optic member 84 into a focused beam 86. Pulsed focused beam 86 passes through window 88 through wall 44 and impinges on tape strip 62 within housing 42. Short wavelength beam 90 exits housing 40 through exit window 92. View window 94 permits observation of focus beam 86 with tape strip 62 within housing 42. It should be noted that shortwave length radiation beam 90 may take the form of UV, extreme UV, X-rays, and the like.

Figure 4:
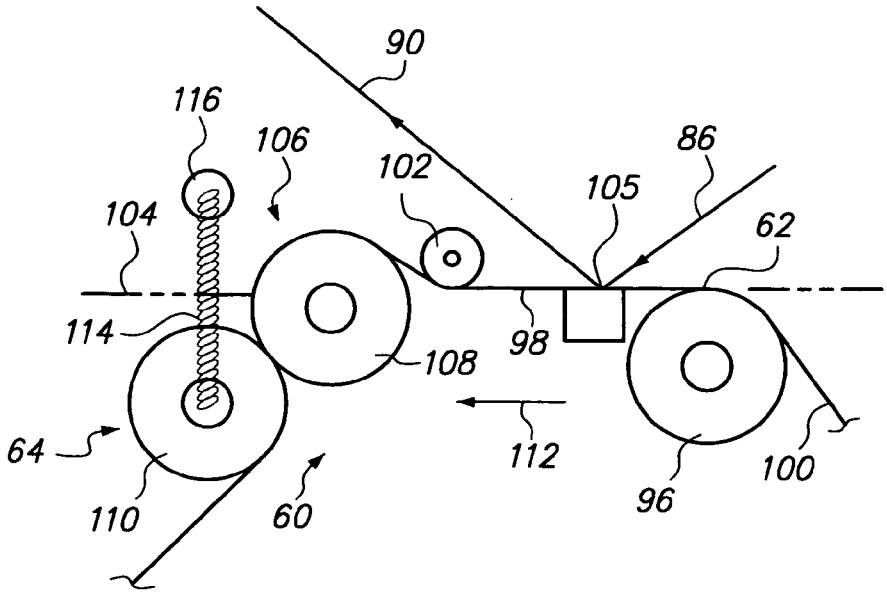
FIG. 4 is a schematic top plan view of a portion of the tape drive of the present invention.
Figure 5:
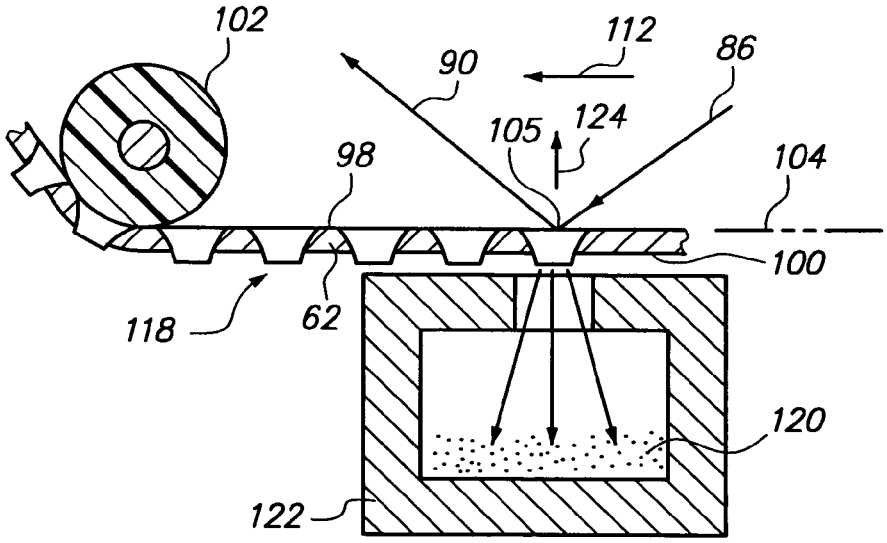
FIG. 5 is a sectional view employing a debris collector and the second projecting element.

With reference to FIGS. 4 and 5, it may be apparent that positioning mechanism 60 is depicted. Positioning mechanism 60 includes a first projecting element 96 in the form of a roller which presents first side 98 of tape strip 62 as a target for impingement with focused laser beam 86. Second side 100 of tape strip 62 contacts roller 96. A second projecting element in the form of roller 102 is spaced from roller 96 and contacts first side 98 of tape strip 62 originating with tape storage unit 52, FIG. 3. Thus, first side 98 of tape strip 62, between rollers 96 and 102, is maintained in a plane 104 which coincides with the focal point 105 of pulse laser beam 86. Take-up means 64 also possesses pinch mechanism 106. Pinch mechanism 106 includes pinch rollers 108 and 110 which provides the proper tension on tape strip 62 as it travels according to directional arrow 112. Spring 114 pulls roller 110 toward posts 116, in this regard.

With reference to FIG. 5, it may be seen that a plurality of dimples 118 are formed on tape strip 62 following impingement of pulsed laser beam 86 with first side 98 thereof. Tape material is associated with dimples 118, thus, extended beyond second side 100 of tape strip 62, but does not upset or remove tape 62 from the coincidence of first side 98 with plane 104, since only first side 98 touches roller 102. Concurrently, debris 120 formed by impingement of focused, pulsed laser beam 86 on first side 98 of tape strip 62 passes into collector 120 which is mounted below tape 62, FIG. 5. It should be noted that directional arrow 124 indicates a small amount of debris passing upwardly from first side 98.

In operation, the user places base 48 and connected spools 54 and 66 as well as positioning mechanism 60 within chamber 46 of housing 42 as shown in FIG. 3. These items may be formed into a cassette for convenience. Laser source 80 then produces a pulsed focused laser beam 86 which enters chamber 46 through window 88. Pulsed laser beam 86 impinges on first side 98 of tape strip 62 unwound from spool 54 of tape storage unit 52. Debris from tape strip 62 is gathered by collector 122 and discarded. Tape strip 62 is maintained in a plane 104 such that the focal point 105 of pulsed focused laser beam 86 remains in focus when tape travels according to directional arrow 112. Such coplanar orientation of tape strip 62 is maintained by the positioning of rollers 96 and 102. Pinch mechanism 106 maintains the tension on tape 62 during this operation. Slipping o-ring or belt 174 between pulleys 76 and 78 of spools 66 and 54, respectively, assures that tape strip 62 moves uniformly according to directional arrow 112 within positioning mechanism 60. 500 meters of metallic tape 58 is capable of receiving 500,000 shots from laser source 80 in apparatus 10.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus providing a source of shortwave electromagnetic radiation utilizing a tape having a first side and a second side and a laser beam focused and impinging on said first side of said tape, comprising:

a. a tape storage unit feeding the tape therefrom;

b. a base;

c. a first projecting element supported relative to said base, said first projecting element contacting the second side of the tape being fed from the tape storage unit;

d. a second projecting element supported relative to said base and spaced from said first projecting elements, said second projecting element contacting the first side of the tape being fed from the tape storage unit wherein the portion of tape positioned between said contact with said first and second projecting units lying in a plane during said feeding of said tape from said tape storage unit, said laser beam being focused and impinging on the first side of the portion of tape positioned between said contact with said first and second projecting units; and e. take-up means for gathering the tape passing between said first and second projecting elements, said take-up means comprising a pinch mechanism simultaneously contacting the first and second sides of the tape fed by said tape storage unit.

2. The apparatus of claim 1 in which said first projecting element comprises a roller.

3. The apparatus of claim 1 in which said second projecting element comprises a roller.

4. The apparatus of claim 3 in which said first projecting element comprises a roller.

5. The apparatus of claim 1 in which said laser beam focused and impinging on said first side of said tape generates debris from said tape and which further comprises a collector for the debris located adjacent said second side of the tape.

6. The apparatus of claim 1 in which said pinch mechanism comprises a pair of rollers.

7. The apparatus of claim 1 in which said take-up means further comprises one spool receiving tape passing through said pinch mechanism.

8. The apparatus of claim 7 in which said tape storage unit comprises another spool.

9. The apparatus of claim 7 in which said take-up means further comprises a motor linked to said one spool.

10. The apparatus of claim 9 which further comprises a belt linking said one and another spools.

* * * * *